United States Patent [19]

Schmiesing

[11] Patent Number: 4,741,662

[45] Date of Patent: May 3, 1988

[54] MATERIAL HANDLING EQUIPMENT

[76] Inventor: Gregory Schmiesing, R.R. #1, New Bremen, Ohio 45869

[21] Appl. No.: 901,133

[22] Filed: Aug. 28, 1986

Related U.S. Application Data

[63] Continuation of Ser. No. 130,564, Mar. 14, 1980, abandoned, which is a continuation of Ser. No. 875,901, Feb. 7, 1978, abandoned, Continuation-in-part of Ser. No. 830,568, Sep. 6, 1977, abandoned.

[51] Int. Cl.[4] ..... E02F 3/342

[52] U.S. Cl. ..... 414/686; 280/766.1; 280/767; 414/718; 414/728

[58] Field of Search ..... 414/686, 718, 728; 280/763.1, 764.1, 765.1, 766.1, 767; 298/17 SG

[56] References Cited

U.S. PATENT DOCUMENTS

| | | | |
|---|---|---|---|
| 2,439,085 | 4/1948 | Grzech et al. | 298/17 SG |
| 3,327,879 | 6/1967 | Lull | 414/718 |
| 3,648,871 | 3/1972 | Layton | 414/718 X |
| 3,791,052 | 2/1974 | Van Der Lely . | |
| 3,967,744 | 7/1976 | Goyarts | 414/718 |
| 4,065,009 | 12/1977 | Old | 414/686 |

FOREIGN PATENT DOCUMENTS

| | | | |
|---|---|---|---|
| 703059 | 2/1965 | Canada | 414/686 |
| 1531808 | 1/1970 | Fed. Rep. of Germany | 414/686 |
| 535597 | 4/1941 | United Kingdom | 280/763.1 |

*Primary Examiner*—Leslie J. Paperner
*Attorney, Agent, or Firm*—Jerome P. Bloom

[57] ABSTRACT

An assembly of lift arms and mounting structure together with simultaneously functioning stabilizers provides improved material handling apparatus for application to small, relatively lightweight vehicles. This apparatus comprises structure for giving the load engaging portions of the lift arms an extended outreach capability, as and when required. The outreach capability in one embodiment is achieved utilizing a traveling base for the lift arms and in another the lift arms comprise telescoping parts. In either case the base for the lift arms may have directly connected stabilizers which preserve balance of the lift arms and the underlying vehicle. The apparatus disclosed features a particularly useful and rugged lift arm assembly having general utility in the material handling art. This assembly provides a pair of arms arranged for pivotal attachment to a base support having telescopically related extensions mounting material engaging apparatus and bridged by structure affording a base for control apparatus connected directly to the material engaging apparatus. The apparatus lends itself to a most efficient leveling operation in respect to deposited material and it is not dependent for its separate utility upon a use therewith of supplementary stabilizers.

14 Claims, 3 Drawing Sheets

3
3

MATERIAL HANDLING EQUIPMENT

This application is a continuation of application Ser. No. 130,564 filed Mar. 14, 1980 now abandoned, which is a continuation of application Ser. No. 875,901 filed Feb. 7, 1978, now abandoned which is a continuation-in-part of application Ser. No. 830,568 filed Sept. 6, 1977, now abandoned.

BACKGROUND OF THE INVENTION

This invention provides improved material handling apparatus for application to small, relatively lightweight vehicles. It has particular advantage for use in application to farm type vehicles and will be so described, but only for the purpose of illustration and not by way of limitation.

The material handling equipment normally incorporated in a vehicle to serve as an agricultural loader comprises lift arms, a bucket type device pivoted to the outer ends of the lift arms, means anchoring the inner ends of the arms to an underlying vehicle and controls for pivoting the arms and tilting the bucket, the latter of which normally embodies tines. This is exemplified by the Series 22 Agricultural Loader made by Dunhan Lehr, Inc. at this time. The disadvantages of this type of conventional construction of a loader is that the outreach capabilities and lift capacity of its lift arms are limited. Instability of the structure is also inherent when applied to certain necessary functions. This mans that in many cases the small loaders are not quite adequate for their intended purpose and make farm jobs much more difficult and time consuming than they should be. Of course, one answer could be the use of much larger, heavier and costlier special equipment such as exemplified in U.S. Pat. No. 3,967,744, which requires the fabrication of a specially adapted or constructed vehicle. However, this ignores the needs and financial limitations of the small operator.

The feature of making extensible booms for lift arms as well as embodying stabilizers in connection with work vehicles is found in special types of equipment in the prior art. In no event, however, has it been found that these features have been so embodied in material handling equipment as to overcome the problems above mentioned, particularly in the limited field of application with which the present invention is concerned.

Apart from the foregoing, a further problem in use of prior art apparatus of the type described is a lack of simplicity in its installation and application and its inadequacy when considering the need for a useful and rugged lift arm assembly having general utility which can be safely and effectively applied to serve a material leveling as well as a lifting and depositing function.

SUMMARY OF THE INVENTION

According to one aspect of the present invention, material handling equipment applied to a small vehicle to form an agricultural loader includes a base which detachably mounts to the vehicle. This base incorporates pivotally connecting lift arms the projected extremities of which carry a relatively tiltable bucket. Means are included to selectively pivot and extend the reach of the lift arms. The base also mounts stabilizer apparatus which when energized projects ground engaging means serving to balance the arms, the load carried by the arms and the underlying vehicle. To provide for extended and versatile outreach of the bucket, in one embodiment the arms track the length of the frame while in another the arms are comprised of telescoping parts, the latter being preferred.

This invention apparatus may be supplied separately for application to any small vehicle or made part of its original equipment. In any case a small vehicle is provided with material handling apparatus having extended reach and lift capabilities and means in connection therewith, per se, which enables its safe and efficient operation without need for vehicle modification.

Loader apparatus according to the present invention may be applied, for example, to any of the commonly used farm tractors. The carrying out of relatively heavy duty work, using a relatively lightweight vehicle, is therefore made possible by the present invention.

The invention also features a distinctive rugged lift arm assembly having general utility. This assembly embodies a telescopically related extension which carries material engaging means at its projected extremity the controls for which are based on said extension. The arrangement provides not only a substantial material handling capability but stability in use thereof sufficient to enable the structure to be applied to an extended leveling of the material lifted and deposited or stacked thereby. In a particularly preferred embodiment, the arm assembly and its extension are designed to enable a horizontal positioning and reciprocation of the extension. This facilitates a simple operation of a bucket carried by the extension for leveling purposes. At the same time, the construction provided enables a dropping of the arm assembly to a lowered position to place the bucket close in to the base vehicle, immediately forward thereof, essentially at ground level. This last facilitates an effective application of the bucket below the level of the ground, readily achieved and enabled by the extension capability and configuration of the lift arm structure provided.

A primary object of the invention is to provide improvements in material handling apparatus making such apparatus particularly advantageous for application to small vehicles whereby to render them more adaptable to and more effective for use in a wide variety of material handling applications.

Another object of the invention is to provide loader apparatus applicable to a farm tractor or like vehicle which has increased outreach capacity, greater loading and unloading efficiency, and the capability of adapting a relatively lightweight vehicle to heavy duty work.

A further object is to provide material handling apparatus for creating an agricultural or like loader incorporating stabilizing apparatus inherently supporting such apparatus and the underlying vehicle against unbalancing load effects.

A still further object of the invention is to provide a compact, vehicular loader with extended reach and vehicle stabilization capabilities.

An additional object is to provide a simple, rugged lift arm assembly including a pair of arms arranged for pivotal attachment to a base support and including a telescopically related extension carrying work engaging means at its projected extremity the controls for which are based on said extension.

Another object is to provide such structure so arranged as to lend it an ability to serve a leveling function without rendering it unstable in use.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the accompanying drawing wherein is shown one but obviously not necessarily the only form of embodiment of the invention, FIG. 1 is a partly diagrammatic side elevation view of one embodiment of material handling equipment in accordance with the present invention;

Like parts are indicated by similar characters of reference throughout the several views.

DESCRIPTION OF PREFERRED EMBODIMENTS

Figure 1:
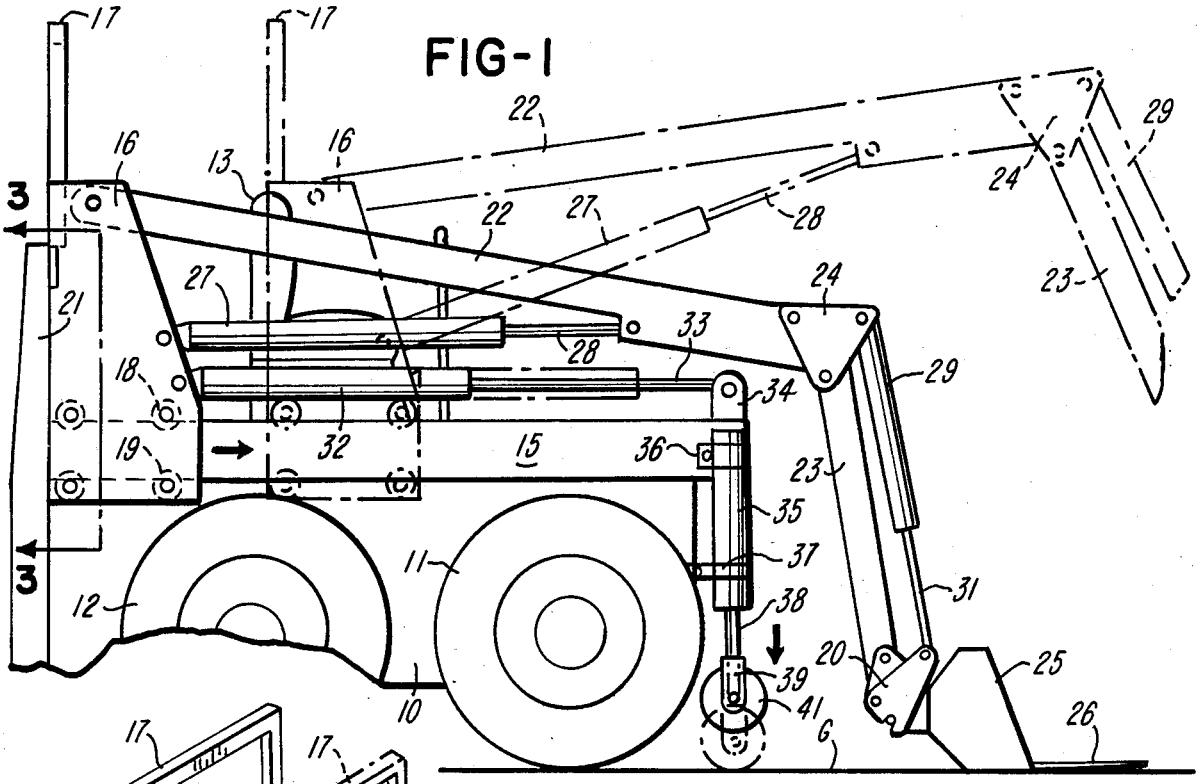
Figure 2:
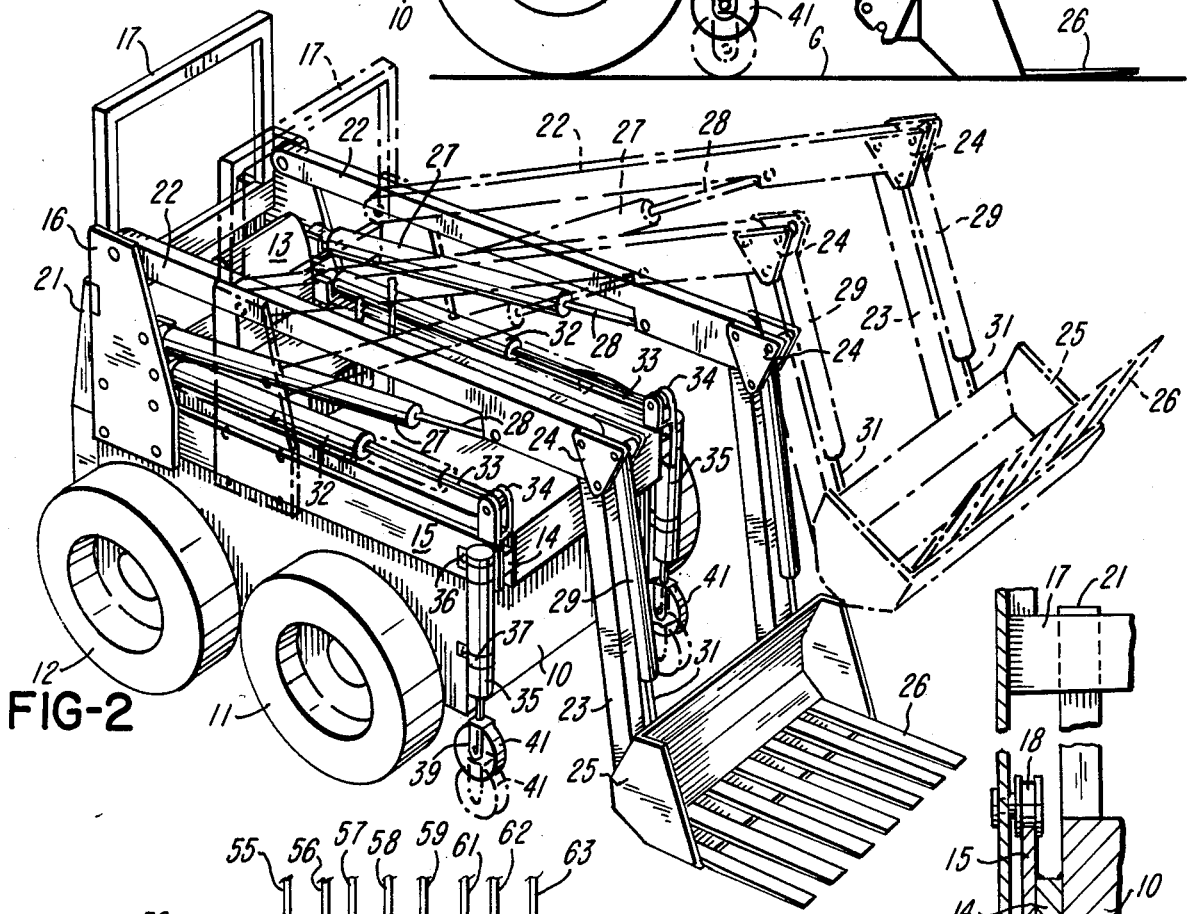
FIG. 2 is a perspective view of the material handling equipment of FIG. 1, hydraulic connections and controls used in the equipment being diagrammatically illustrated in FIG. *2a;*
Figure 3:
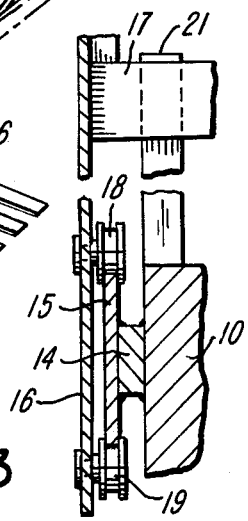
FIG. 3 is a fragmentary sectional view taken substantially along the line 3—3 of FIG. 1.

In FIGS. 1 to 3, material handling apparatus in accordance with this illustrated embodiment of the invention is applied to a compact, truck-like vehicle including a body 10 conventionally mounted on front wheels 11 and rear wheels 12. Atop the body 10 and positioning intermediate its side margins is a seat 13 from which an operator can control the various machine operations.

The material handling apparatus comprises a narrow mounting bar 14 secured to an upper part of the body 10 along each side thereof. To the outer side of each bar 14 is secured a plate forming a rail member 15, the arrangement of parts being one to place the rails 15 in a parallel spaced flanking relation to the body 10. The rails 15 may be regarded as the base frame portion of the applied material handling apparatus which in this instance constitutes agricultural loader apparatus. The lengths of the rail members 15 are coextensive with that of the body 10.

An upstanding plate 16 is mounted to the rear end portion and to the outer face of each rail member 15. The plates 16 bound and are interconnected with a rectangular frame 17 to form therewith a supplemental frame assembly which positions perpendicular to the base frame comprises of the rails 15. On what may be regarded as an inner face of each plate 16 are upper and lower sets of rollers 18 and 19. The rollers 18 and 19 respectively engage over the upper and lower edges of the respective rail members 15 and so mount the vertical frame assembly comprised of the plates 16 and frame 17, for motion along the rail members 15. A rearmost limit of movement of the vertical frame assembly is defined by abutment means 21 upstanding from the rear end of the body 10 for engagement by the frame 17.

Further comprised in the material handling apparatus is a pair of lift arms, each having what may be regarded as an inner end portion 22 pivotally connected at its innermost end to a respective one of the plate members 16. At an outer end thereof, each arm portion 22 is joined to an outer arm portion 23 fixed to depend therefrom and to form therewith an obtuse angle. The joint between each inner arm portion 22 and the connected outer arm portion 23 is confined between relatively fixed opposing triangular plates 24 which are parallel. Between their outer ends, arm portions 23 support a load engaging "bucket" 25 fitted in the illustrated instance with tines 26 adapting it to the loading and handling of silage, manure and other farm related materials. The base of the load engaging device or bucket 25 is pivotally connected to arm portions 23 for relative tilting motion through parallel plate means 20 fixed to its outer sides.

Each plate member 16 has pivotally anchored thereto the inner end of a hydraulic cylinder 27, the outer end of the projected piston rod 28 of which is pivotally connected to an underside of the adjacent lift arm portion 22 which has its inner end pivotally connected to the same plate member. The cylinders 27 thus orient in a generally overlying relation to the respective sides of body 10 and extend toward the front thereof. Piston heads on the ends of the rods 28 within the cylinders are conventionally subject to application of hydraulic fluid under pressure to produce a raising or lowering of the lift arms as and when required. Each pair of plates 24 mounts therebetween one end of a pivotally connected hydraulic cylinder 29 having a rod 31 extending therefrom to make a pivotal connection with the plate means 20 which is immediately forward. Extending and retracting motions of rods 31 result, through the medium of the plate means 20, as will be apparent, in a tilting of the bucket 25 on the outer ends of the lift arms.

Since the lift arms 22–23 are based on the vertical frame assembly comprised of parts 16 and 17, longitudinal movement of this assembly toward the front end of the body 10 has the effect of moving the lift arms and its connected bucket 25 to a position wherein they project forwardly of the body 10. This extends substantially the outreach of the loader mechanism giving it a much wider range in a manner to facilitate loading and unloading operations as well as material placement, as for example in the dumping of loads into relatively remote portions of a truck body from a position in which the underlying body 10 has been fixed.

Extending and reducing the reach of the loader apparatus is, accordingly, a function of the relative longitudinal movements of the vertical frame assembly 16–17 on the rails 15. Anchored at one end to each plate member 16 and projecting forwardly therefrom in underlying relation to the hydraulic cylinder 27 connected to the same plate member is a hydraulic cylinder 32 similar to the cylinder 27. A piston rod 33 extends from each cylinder 32 to pivotally attach at its outer end to a bracket 34 fixed to a forward end of the adjacent rail 15. Under an appropriate control of the pressure fluid applied in the cylinders 32, therefore, the cylinders are caused to move back and forth on the piston heads on the end of the rods 33 within the cylinders, these movements causing longitudinal sliding motion of the vertical frame assembly 16–17.

Appropriately secured by a strap 36 also to the outer end of each rail 15 is a hydraulic cylinder 35 having a piston rod 38 connected with and projected outwardly from a head within the cylinder. The cylinders 35 project downwardly from respective rails 15, orienting in a generally parallel relation and in a sense generally perpendicular to ground surface G. If necessary, or desirable, additional straps 37 may be provided for attaching the cylinders 35 to the vehicle body 10. The rod 38 projects from the lower end of each cylinder 35 and its projected end carries a bracket 39 relatively rotatably mounting a wheel 41. Wheels 41 are adapted to engage ground surface G for an anti friction contact therewith. The arrangement provided places the hydraulic cylinders 35 at the front end and slightly forwardly of the vehicle body 10. Extension of the rods 38 to engage wheels 41 with ground surface G accordingly stabilizes the vehicle body and prevents tilting movements thereof as the lift arms are lifted and projected, and at the same time does not impede normal movements of the vehicle along the ground surface.

Figure 2A:
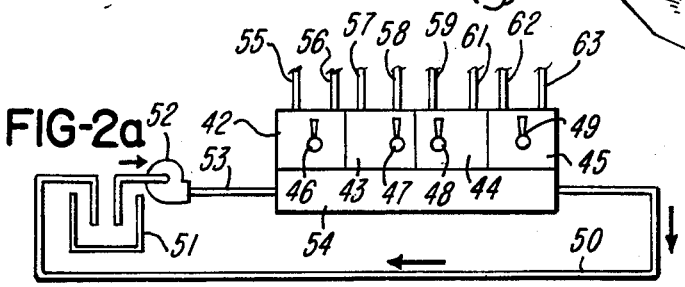

From his position in seat 13, through conventionally provided controls the operator can maneuver the vehicle, and, at the same time, can variously raise and lower the lift arms 22–23, tilt the bucket 25 and extend and retract the frame assembly 16–17 to extend and reduce the reach of the lift arms. Conventional mechanism and controls to maneuver the vehicle and the lift apparatus are not shown in the interest of simplicity of disclosure, particularly since they may be contrived by mechanics in the art and are not necessary for an understanding of the invention. For purpose of this disclosure, controls for effecting the several described power operations are here illustrated only in a diagrammatic form. These may include, as shown in FIG. 2*a*, a series of valves 42–45 having respective actuators 46–49. The several control valves, it will be understood, are positioned to be conveniently accessible to an operator in seat 13. The valves 42–45 are a part of a hydraulic system further including a reservoir 51 of hydraulic fluid and a pump 52. The pump 52 draws fluid from reservoir 51 and delivers it under pressure through a line 53 to a manifold 54 common to the several valves, with return flow being by way of return flow line 50. Under control of valve 42, pressure fluid is directed to and from the hydraulic cylinders 27 by way of lines 55 and 56. Under control of valve 43 pressure fluid is directed to and from hydraulic cylinders 32 by way of lines 57 and 58. Valves 44 and 45 similarly direct pressure fluid to and from the cylinders 35 and 29 by way of respective sets of flow lines 59 and 61 and 62–63. In accordance with a preferred embodiment of the invention, the valves 43 and 44 are placed in an adjacent relation to one another with actuators 47 and 48 close together so that both may, if desired, be operated simultaneously by the operator, using only one hand. In this connection, it is pointed out that energizing of the cylinders 32 to extend the reach of the lift arms desirably is accompanied by an energizing of cylinders 35 to extend wheels 41 to contact ground surface G. In this manner, over balancing stress forces which may be developed as a result of working the bucket 25 while the lift arms are extended relatively to the vehicle body·are opposed and generally nullified. A stabilized position of the vehicle accordingly is assured under all conditions of operation without a need to build excessive weight into the vehicle. A relatively lightweight vehicle, equipped with stabilizer apparatus according to the invention, may perform heavy duty work heretofore reserved to much larger, heavier vehicles.

In the operation of the material handling apparatus, the vertical frame assembly 16–17 normally is in a retracted position, substantially as illustrated, and rods 38 to which are attached stabilizer wheels 41 are retracted within cylinders 35, raising the stabilizer wheels out of contact with ground G. The lift arms are in a lowered position, and, upon the vehicle being advanced toward the work, bucket 25 engages material to be lifted and transferred or loaded. When the bucket has taken on a sufficient load of material, valve actuator 46 is operated to direct pressure fluid to the one ends of cylinders 27 while opposite ends are connected for a return flow of fluid. In this manner, lift arms 22–23 are raised, and, when a desired height has been reached, actuator 46 is set to hold the parts in the position so attained. Then, or at an appropriate moment in accordance with the work to be done, valve 45 is actuated to direct pressure fluid to one end of the cylinders 29 while allowing fluid to return from opposite cylinder ends. The result of this is to tilt the bucket 25, emptying its contents in the manner or at the place desired. Under further control of the actuators 46 and 49, the lift arms may be lowered and the bucket repositioned for an additional lifting operation. When, in the course of the loading or unloading operation being performed, it may become desirable to extend the reach of the lift arms, actuator 47 is adjusted to direct pressure fluid to the outer ends of the cylinders 32 while allowing fluid to return from the inner ends thereof. This causes a relative telescoping motion of cylinders 32 on their respective piston rods 33, moving the frame assembly 16–17 to a position forwardly of the vehicle, as for example from the full line to the dotted line position shown. With the parts so positioned, lifting or loading and unloading operations are carried out as before, with, however, the loader apparatus now having a greater outreach, extending its utility and capabilities. In conjunction with adjustment of actuator 47 to extend the outreach of the lift arms, actuator 48 is operated to project rods 38 from the lower ends of cylinders 35. This causes wheels 41 to engage with ground surface G and accordingly stabilize the vehicle against over balancing effects which may result from operation of the loader under conditions providing the lift arms are relatively extended. In accordance with the adjustment of actuator 48 hydraulic pressure is continuously applied, while the lift arms are raised and lowered in their relatively extended position. In conjunction with a retraction of the frame assembly 16–17, to retract the lift arms, the rods 38 may concomcomitantly be retracted within cylinders 35 to lift wheels 41 from the ground surface G. On the other hand, since actuator 48 is independently operable, the stabilizing influences brought about by contact of the wheels 41 with ground surface may be achieved at any time. Since they roll freely on ground surface G, the wheels 41 do not hamper or interfere with free movement of the vehicle on its wheels 11 and 12.

Figure 4:
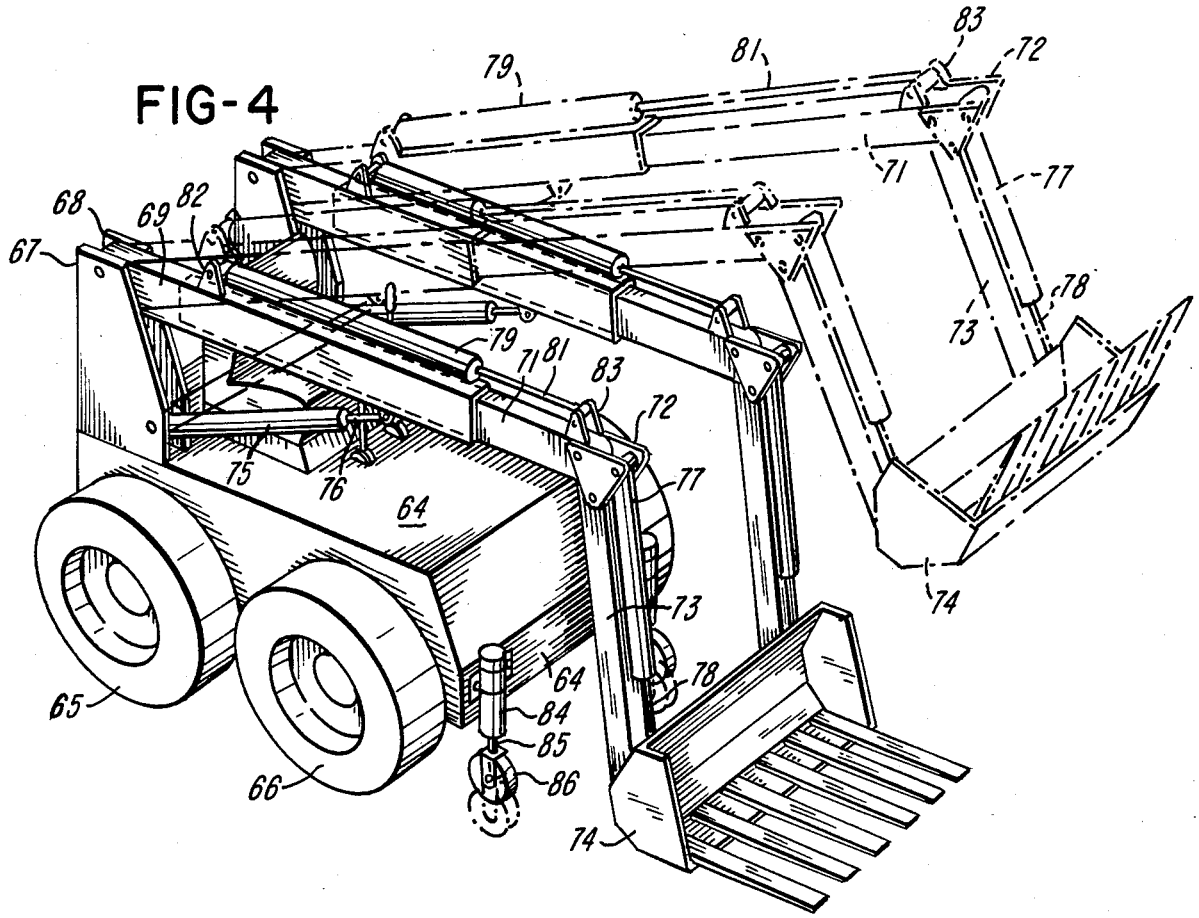
FIG. 4 is a generally diagrammatic view similar to FIG. 2, omitting hydraulic connections and controls, showing a second illustrated form of material handling equipment per the invention.

In that embodiment of the invention in FIG. 4, a vehicle body 64 is shown as mounted on wheels 65 and 66. Toward what may be regarded as the rear end of the body 64, at each corner thereof is mounted a pair of spaced apart vertical and upwardly projected plate members 67 and 68 which are parallel to each other and the body sides. Unlike the plate members 16 of the first considered embodiment, however, the plate members 67 and 68 are fixed to the body 64. Pivotally supported on and between the upper ends of each pair of members 67 and 68 is the inner end of a lift arm portion 69 which projects forwardly of the body 64 and receives in a telescoping relation thereto a forward lift arm portion 71. Secured by plates 72 to depend from the outer end of each lift arm portion 71 is a further lift arm portion 73 fixed to form therewith an obtuse angle. The lower ends of the lift arm portions 73 pivotally mount a load engaging bucket 74.

The lift-arm bucket assembly is raised and lowered by actuating the piston rods 76 of hydraulic cylinders 75 respectively pivotally connected at one end between one pair of the plate members 67 and 68. The rod 76 extending from each cylinder 75 attaches to a respective lift arm portion 69 at the same side of body 64. Relative tilting of the bucket 74 is accomplished by means including a pair of hydraulic cylinders 77 one end of each of which pivotally connects to and between one of the pairs of plates 72. A rod 78 extending from each cylinder 77 pivotally connects to bucket 74.

It will be understood, of course, that in referring to the rods associated with each hydraulic cylinder herein described each such rod includes at its end within the related cylinder a piston head which divides the interior of the cylinder into two chambers each of which contains hydraulic fluid, the movement of which to and from the chambers effects the movement of the piston head and thereby the related rod, or the cylinder.

Relative extension and retraction of the lift arm portion 71 within each lift arm portion 69 is effected by hydraulic means including a cylinder 79 and a rod 81 having its piston head housed in the cylinder 79. One end of the cylinder 79 pivotally connects to a bracket 82 upstanding from the lift arm portion 69. The projected end of its rod 81 is pivotally connected to a bracket 83 upstanding from lift arm portion 71. The arrangement is one in which projection of rod 81 from cylinder 79 projects lift arm portion 71 relative to lift arm portion 69 and effectively extends the outreach of the lift arm assembly and its connected bucket.

Hydraulic cylinders 84 are fixed to the front of vehicle body 64 in a sense perpendicular to the ground G. Rods 85 depend from the lower ends of the cylinders 84 and mount wheels 86 on their lower ends.

Controls for the apparatus of FIG. 4 are or may be the same as those illustrated in connection with the FIGS. 1 to 3 embodiment. Under suitable valve control, cylinders 75 are energized to raise and lower the lift amrs 69, 71, 73; hydraulic cylinders 79 are energized to extend and retract arm portions 71, thereby to extend and reduce the outreach of the lift arm assembly; and cylinders 84 are energized to stabilize and prevent unbalancing forces on the vehicle and the lift arms in conjunction with projection of the lift arm portions 71. Elevation of the lift arms and supported bucket 74 is substantially from the full line to the dotted line position of FIG. 4. It will be understood that, in any position of elevation of the lift arm assembly, cylinders 79 may be energized alternatively to extend or to reduce the outreach of the loading apparatus.

In the invention embodiments of FIGS. 1 to 4, the vehicle to which the loading apparatus is applied is diagrammatically shown as a compact truck-like device especially adapted for close quarter maneuvering in loading operations. In the case of the embodiment of FIG. 5, the loading apparatus is illustrated as embodied in a detachable accessory applicable to a general purpose vehicle such as a farm tractor. As illustrated, the tractor may comprise a forwardly tapering engine housing 87 seated to a chassis frame 88 carried in turn by differentially sized front and rear wheels 89 and 91. A seat 92 for the operator mounts on the chassis 88 to the rear of engine housing 87.

The loader apparatus in this embodiment includes laterally spaced apart pairs of plate members 93 and 94 which correspond generally to the members 67 and 68. However, in this case the plate members 93 and 94 are part of a separable loader structure and mount to trunnions 95 fixed to project laterally from the tractor chassis. The mounting of the plate members 93 and 94 is not detailed since the means necessary for this purpose may take any convenient form. It appears sufficient to note that the plate members of each pair have laterally aligned notches or openings from their lower end portions by means of which they may be slip fit over the trunnions 95. The positioning of the plate members on the trunnions and the fixing thereof relative the chassic may involve spacers and nut-like devices appropriately applied in a manner which would be obvious to any mechanic. Considering the pairs of plate members 93 and 94 mounted to their respective trunnions, it will be seen that they are laterally spaced and relatively aligned. Fixed on the innermost side of each plate member 94, which positions most adjacent the chassis 88, is what may be regarded as the rear end of an arm 96. The forwardmost end of each arm 96 is positioned immediately forward of the engine housing 87 and includes a dependent tab 97. Bridging the tabs 97, and interconnected therewith, is a rod 98. The structure comprised of the plates 93 and 94 together with the arms 96, their tabs 97 and the rod 98 form what may be considered as a unitary frame assembly readily mounted to a vehicle body of the type described. The unitary frame assembly may be brought to an embracing relation to the tractor chassis in any convenient manner, as by driving the tractor between arms 96 until plates 93–94 are brought to a cooperative relation with trunnions 95.

Figure 5:
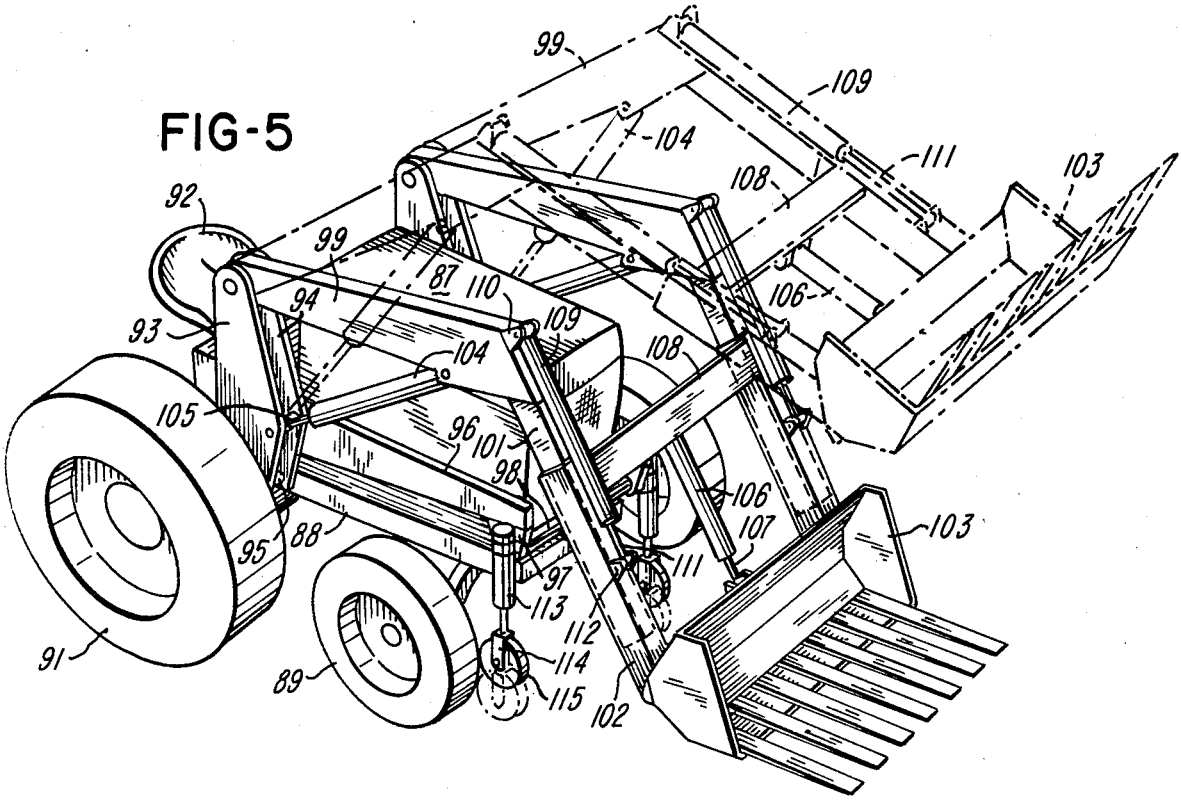
FIG. 5 is a view similar to FIG. 4, showing still another form of its embodiment.

In FIG. 5, lift arms each include an inner arm portion 99 pivotally attached at its rear end between the upper ends of a pair of the plates 93, 94. At the outer or forwardmost end thereof each arm portion 99 is rigidly connected to a dependent arm portion 101 which forms therewith an obtuse angle. The arm portion 101 telescopically mounts a further arm portion 102, the portion 101 being the male portion.

The arm portions 102 of the lift arms have their outermost projected ends bridged by a pivotally connected relatively tiltable bucket 103.

In order to raise and lower the lift arms, there is pivotally attached to the underside of each arm portion 99, adjacent its forward projected extremity, one end of a hydraulic cylinder 104 from the opposite end of which projects, conventionally, a piston rod 105 the projected extremity of which is pivotally connected between the adjacent plate members 93, 94 in line therewith.

The innermost ends of the arm portions 102 are bridged by a cross bar 108 serving to anchor one end of a cylinder 106 from the opposite end of which projects a rod 107 pivotally attached to a projection from the bucket 103, at its bottom. As will be obvious, with a conventional control of the fluid interiorly of the cylinder 106, to either side of the piston head of the rod 107 which is housed therein, one may act to appropriately tilt the bucket 103 as and when required.

To extend the outreach of the lift arms in this case a hydraulic cylinder 109 is associated with each lift arm by having its inner end provided with a pivotal connection with bracket means 110 upstanding from the outer end of its arm portion 99. The rod 111 which projects from the opposite end of the cylinder pivotally connects to a bracket means 112 fixed on and upstanding from the uppermost surface of the adjacent arm portion 102 which telescopically mounts on the intermediately positioned arm portion 101. Thus, projection and retraction of the rods 111 produce corresponding projection and retraction of the arm portions 102 and thereby of the bucket 103.

Stabilizer apparatus is provided in this case by mounting a hydraulic cylinder 113 to the forwardmost end of each arm 96 by fixing one end thereof to its tab 97 in a manner such that when the material handling apparatus is assembled to the chassis 87 the cylinders 113 depend in parallel relation and in a sense perpendicular to the underlying ground surface G. The cylinders 113 have the rods 114 thereof projecting from their lower ends. The dependent extremities of the rods 114 each mount a relatively rotatable wheel 115.

As in the prior considered embodiments, hydraulic controls exist whereby an operator in the seat 92 may raise and lower the lift arms, may tilt the bucket 103, may energize cylinders 109 to extend and reduce the outreach of the lift arms and may energize cylinders 113 to project stabilizer wheels 115 into contact with the underlying ground surface. As in cases previously described, the wheels 115 may be caused to contact ground surface either independently of or in conjunction with an extension of the outreach of the lift arms. In any case, with an outreach the stabilizers are energized so that the wheels 115 move to prevent unbalance of the lift arm assembly and the vehicle to which said assembly is connected.

As indicated, the embodiment of FIG. 5 discloses a loader apparatus which can be quickly attached to or detached from a farm tractor or similar vehicle. Once the loader assembly is coupled to the tractor, all one needs to do to make it operative is to couple the lines for transmitting hydraulic fluid to the various hydraulic cylinders to the hydraulic system normally provided in connection with the tractor. The means and methods of applying the hydraulic system of the tractor to achieve a function of the attached loader apparatus is well within the skill of a mechanic versed in the hydraulic arts and need not be here described since in and of themselves such details form no part of the present invention.

Simplicity and improvement of construction and distribution of controls is exhibited in the projectable and retractable lift arm portions which mount the bucket 103 in this last described embodiment of FIG. 5.

As there seen, the tie bar 108 not only has a strengthening and stabilizing influence on the bucket and the arm portions 102 to which it is fixed and which it ties together but it serves as an ideal base for the hydraulic cylinder 106. The position and mount of the cylinder, in turn, provides for a better and stronger control for the manipulation and support of the bucket. This is apart from the fact that the features noted provide ease of assembly and maintenance and longer useful life for the parts employed in the material handling apparatus.

The embodiment of FIG. 5 does in fact provide a lift arm assembly of an improved nature the construction of which gives it general utility. This is demonstrated in FIG. 6 which shows the structure in a use and in an embodiment where the stabilizing means included in FIG. 5 are not required.

Figure 6:
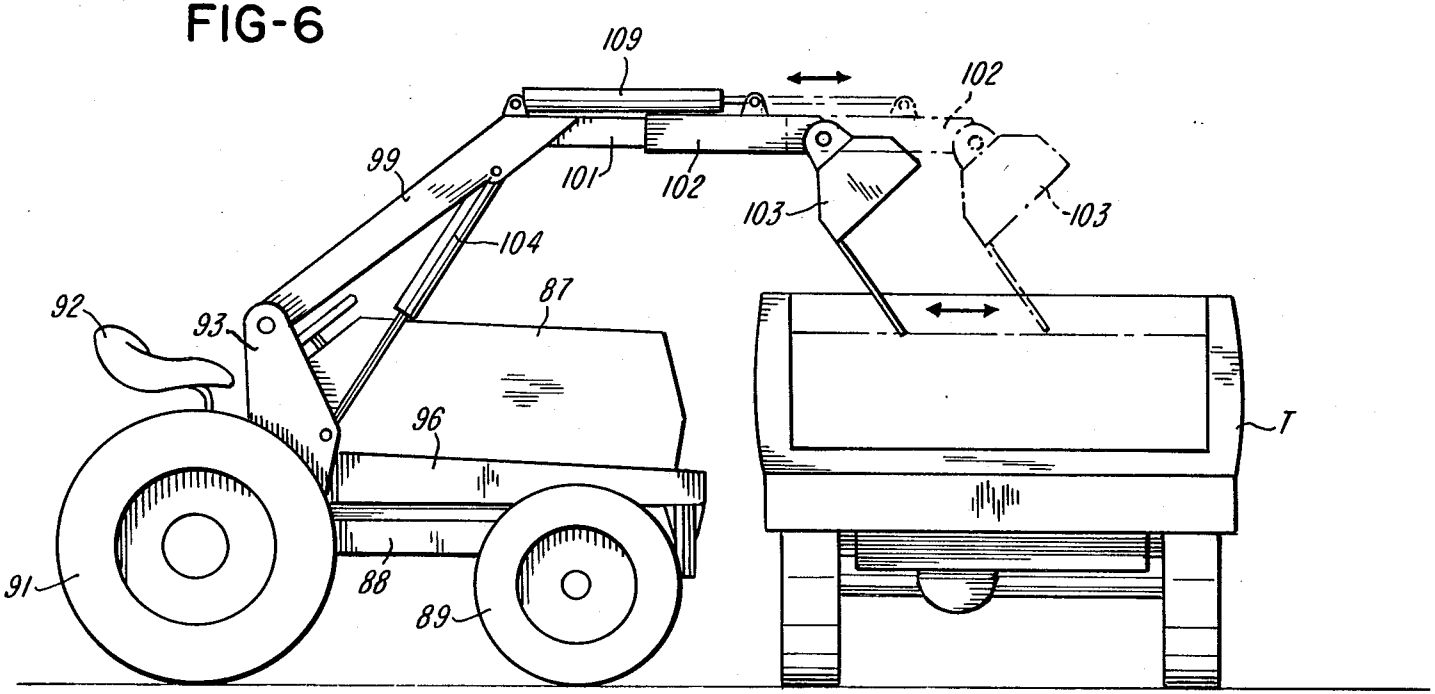
FIG. 6 illustrates the lift arm assembly of the embodiment shown in FIG. 5 in an arrangement where it serves a leveling as well as a lifting function.

FIG. 6 illustrates the manner in which the lift arm assembly may not only be efficiently employed to move material but also to level and spread the material as it is deposited or loaded and stacked. As seen, the tractor on which the lift arm assembly is based is moved in close to a truck being loaded and the arm units of the lift arm assembly comprised of the arm elements 99, 101 and 102 are shown elevated to a position where the bucket 103 loaded with material has been lifted above the bed of a truck T and the material has been released. Note that in the elevation of the arm units of the assembly the portions 102 have been kept essentially in the retracted position and their orientation has been made such to approach a horizontal. Under such conditions the arms are relatively close in and above a tractor and the bucket 103 is above and immediately over one side portion of the truck bed. Of course, the material is released from the bucket by projection of the rod 107.

With the bucket in this dropped position, the cylinders 109 may then be energized to project and retract their piston rods 111, as a result of which to project and retract the arm portions 102, in the process of which the tines on the bucket can be used to spread the material deposited in the truck, across and from side to side of the truck bed. By such means the arm assembly can be made to function to load the truck bed fully and to its maximum in a quick and efficient fashion.

With the arrangement described and by reason of the rugged construction of the projectable and retractable end portion of the arm assembly which embodies therein the means for manipulating the bucket, one not only can provide an extended outreach in use of the arm assembly but also a capability of a highly utilitarian function in the course of which deposited material may be efficiently spread in the area desired for its deposit.

The just described structure has the unobvious advantage of eliminating need for time consuming spreading operations and expensive manpower required in this process. The benefits are self evident, particularly when considering the needs of the marginal farmer. This structure therefore provides the most preferred embodiment of the present invention.

Noting FIG. 5 once more, attention is directed to the fact that when the inner arm portions 99 of the embodiment illustrated are dropped to an essentially horizontal position, the projectable arm portions 102, which are at this time retracted, place the bucket 103 essentially at ground level. Should operations be required below ground level, the arm portions 102 can be readily projected and retracted and controlled to function as required below ground level.

From the above description, it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

With reference to the novelty expressed in the following claims, neither the inventor nor any other party who has been involved in the preparation of this disclosure is aware of any prior art more pertinent than that referred to above.

The embodiments of the invention in which an exclusive property or privilege is claimed are defined as follows:

1. Material handling apparatus comprising a pair of lift arms each including an inner portion one end of which pivotally connects to means for the coupling thereof to a vehicle chassis and the opposite outer end portion of which mounts in reciprocable relation thereto an outer arm portion, said inner arm portion being configured to have said opposite outer end portion thereof bend obtusely to its inner end portion, said arms in application to a vehicle chassis disposing respectively adjacent to opposite sides thereof, means for pivoting said arms relative to their coupling means to raise and lower said arms relative the chassis to which they are applied, the configuration and obtuse relation of said outer to said inner end portions of said arms being arranged to provide that, in the elevation of said arms, said outer end portions thereof may be established in a generally horizontal position, material engaging means connected to the outer end portions of said arms and means interconnecting said inner and outer arm portions for reciprocating said outer arm portions to project and retract said outer arm portions, thereby to give said arms extended outreach capabilities and substantial spreading capabilities, said coupling means being connected with and forming part of a frame arranged for an interfit thereof as a unit to the chassis, together with said pivotally connected arms, said frame embodying in connection therewith vertically dependent leg portions, portions of which are movable to said frame and from said frame to the ground surface which underlies the chassis to which said frame is applied, the dependent extremities of said leg portions being formed for ready movement over the underlying ground surface when projected thereto.

2. Apparatus as in claim 1 wherein said dependent leg portions include at least one hydraulic cylinder housing containing a piston head having an interconnected rod projected from one end of said housing and roller means on the projected end of said rod to provide therewith a movable portion of the dependent leg portion of which it forms a part, whereby on selective application of hydraulic pressure to said head within said cylinder housing one may produce a selective projection of said rod to cause said roller means to engage and bear on the ground surface underlying the vehicle to which said material handling apparatus is applied.

3. Apparatus as in claim 1 wherein said leg portions are constructed and arranged so that on application of said frame to a chassis, they position at and outwardly of the forward end thereof.

4. Equipment providing material handling apparatus applicable to small vehicles such as agricultural loaders including lift arms, means for mounting said lift arms to a vehicle, said lift arms each having one end thereof adapted for pivotal connection to its mounting means and in side elevation having the end portion thereof which positions outermost from said mounting means obtusely angled with reference to its preceding portion, rigidly connected thereto and mounting thereon means for selectively extending or reducing the reach thereof and means for operative association with said mounting means and connection therewith to the vehicle to which the mounting means is applied arranged to position forwardly of the vehicle and to operate in conjunction with extension of the reach of said lift arms to stabilize against unbalancing effects of an engaged and supported load, said stabilizing means including vertically dependent leg portions, portions of which are movable to said mounting means and from said mounting means to the surface which underlies said vehicle to which said mounting means is applied, the dependent extremities of said leg portions being formed for ready movement over the underlying surface when projected thereto.

5. Apparatus for application to a farm tractor or like vehicles having a particular facility for use in spreading and levelling a deposited load comprising a pair of lift arms which are arranged to position in connection with and adjacent respectively opposite sides of said vehicle, each said arm including an inner end portion pivotally connecting to means for the coupling thereof to said vehicle and an outer end portion connected to depend from and form an obtuse angle with said inner end portion thereof, said arms being arranged to extend from said coupling means in a substantially parallel laterally spaced aligned relation, means for pivoting said arms relative to their coupling means to raise and lower said arms relative to the vehicle to which they are applied, the configuration and obtuse relation of said outer to said inner end portions of said arms providing that in the raising and lowering thereof said outer end portions of said arms may be established in a horizontal position essentially parallel to an underlying support surface on which material has been deposited, said outer end portions of said arms mounting a slidably related material handling assembly for a longitudinal inward and outward movement thereof thereon and with respect thereto, said material handling assembly including arm extensions respectively telescopically related to said outer end portions of said arms and a material handling device, said material handling device being interconnected with and in a bridging pivotal relation to said arm extensions to render it tiltable to various attitudes of use, further means in connection with said arm extensions at a point immediately to the rear of said material handling device operative to effect tilting movements of said material handling device and to hold said device in a selected tilted position, means mounting on a portion of said arms immediately to the rear of said material handling assembly connected to and operable independently of the operation of said further means to effect essentially straight line inward and outward and reciprocating movements of said assembly on and with respect to said outer end portions of said arms and selectively with said material handling device held in any selected tilted position in which it may have been set for a spreading and levelling operation, said arms and the means for pivoting thereof being constructed and arranged in the pivoting of said arms to position said outer end portions of said arms generally horizontal, in a vertically spaced substantially parallel relation to an underlying support surface with said further means set to establish a portion of said material handling device in a levelling position for its reciprocation with said material handling assembly on and with respect to said horizontally positioned outer end portions of said arms to spread and level a load of material deposited on said underlying support surface.

6. Apparatus is in claim 30 wherein said means for coupling said arms to said vehicle includes a frame arranged for the interfit thereof to one end and to opposite sides of said vehicle and said frame, said arms and the elements mounted for movement on and in connection with said arms constituting a separable assembly which is adaptable for the mounting thereof to any selected vehicle.

7. Apparatus as in claim 6 wherein said frame embodies in connection therewith vertically dependent leg portions, portions of which are movable to said frame and from said frame to the ground surface which underlies said vehicle to which said frame is applied, the dependent extremities of said leg portions being formed for ready movement over the underlying ground surface when projected thereto.

8. Apparatus as in claim 5 wherein said independently operable means comprise a pair of actuators, one for each lift arm, respectively connected to dispose above and parallel to said outer end portions of said lift arms, inner ends of said actuators connecting to respective lift arms and outer ends thereof connecting to respective arm extensions.

9. Apparatus as in claim 5 wherein said material handling device is pivotally connected to the outer ends of said arm extensions at locations which are laterally spaced, a tie bar is interconnected with and in bridging relation to said arm extensions and said further means is operative to effect tilting movements of said material handling device and to hold said device in a selected tilted position and includes an actuator based on said tie bar and extending therefrom to pivotally connect to said material handling device at a location intermediate the locations at which said arm extensions connect to said material handling device.

10. Agricultural material working and handling apparatus applicable to farm tractors and like vehicles having a particular facility when connected therewith for loading, unloading and for spreading and levelling deposited material, comprising a frame assembly, said assembly including laterally spaced apart frame elements adapted to detachably mount to respectively opposite sides of such a vehicle, parallel lift arms each pivotally connected at its inner end portion to one of said frame elements to dispose said lift arms at respectively opposite sides of such vehicle, outer end portions of said lift arms being obtusely angled with respect to and dependent from their inner end portions to have a degree of angularity therebetween such that in their application to a vehicle said outer end portions may assume a position with respect to the vehicle which is substantially parallel to an underlying support surface, at which time said inner end portions are well below a vertical, arm extensions slidable on said outer end portions of the lift arms for reciprocation in whatever plane may be assumed by said outer end portions relative to said underlying support surface, a tie bar interconnecting said arm extensions for their conjoint motion, a material handling device carried by and between said arm extensions and pivotally connected thereto for relative tilting movements thereon, means extending between said frame elements and said lift arms for raising and lowering said lift arms, means mounted on said arms and extending between said outer end portions of said arms and said arm extensions operable to extend and retract said arm extensions and said interconnected material handling device relative to said arms and means extending between said tie bar and said material handling device and forming therewith an assembly including said arm extensions, said means extending between said tie bar and said material handling device being operative to tilt said device relative to said arm extensions, said raising and lowering means, said extending and retracting means and said tilting means being independently operable extensible and retractable actuators operable to selectively maintain said arm extensions and said material handling device in set positions and, said means extending between said tie bar and said material handling device being operable to tilt, establish and hold said material handling device to set a portion thereof in a selected attitude of use for a load spreading and levelling operation utilizing only said means for extending and retracting said arm extensions.

11. Agricultural material handling apparatus for application to a farm tractor or like vehicles having a particular facility for use in spreading and levelling a deposited load comprising a pair of lift arms each arranged to pivotally attach, at what constitutes its inner end, to a support at one of the opposite sides of a vehicle chassis, said arms being positioned in a transversely spaced substantially parallel relation, each of said arms having an outer end portion forming an obtuse angle with the portion thereof including its inner end, the said outer end portions of said arms cooperating in the support of an assembly including a material handling device, said assembly being mounted for reciprocation longitudinally of said obtusely angled outer end portions of said arms and said material handling device being tiltable to various attitudes of use relative to the other components of said assembly, means for reciprocation of said assembly located on the outer end portions of said arms immediately to the rear of said assembly, and means independent of said last named means wholly comprised in and forming part of said assembly located immediately to the rear of said material handling device operable to effect a tilting adjustment and set of said material handling device to a selected attitude of use independent of said reciprocating means and said means for reciprocation of said assembly being operable to reciprocate said assembly with said device in said selected attitude of use independently of said tilting means in a sense longitudinally of said outer end portions where required for spreading and/or levelling material deposited on an underlying support surface.

12. Material handling apparatus for application to a farm tractor or like vehicle having a particular facility for use in spreading and levelling a deposited load comprising a pair of lift arms each arranged to pivotally attach, at what constitutes its inner end, to a support at one of opposite sides of a vehicle chassis to position said arms in a transversely spaced substantially parallel relation, each of said arms having a fixed outer end portion forming an obtuse angle with the portion thereof including its inner end, said outer end portions of said arms cooperating in the support of an assembly including a material handling device and self contained means for tiltably adjusting and setting said material handling device in selective positions of use, means based on said outer end portions of said arms operable independent of said self contained means to move and reciprocate said assembly independent of the setting or adjustment of said material handling device or any control or movement of said arms, said assembly being mounted for reciprocation longitudinally of said obtusely angled outer end portions of said arms and said material handling device being tiltable relative to other components of said assembly to establish a portion thereof in an attitude of use whereby said material handling device may be reciprocated to achieve spreading and leveling of materials deposited on an underlying support surface.

13. Apparatus as in claim 12, said tilting means including an activator one end of which is connected directly to said material handling device and an opposite end of which is based on means forming a part of said assembly.

14. Material handling apparatus for application to a small relatively lightweight farm tractor or like vehicle having a particular facility for use in spreading and levelling a deposited load comprising a pair of lift arms, said arms each including an inner arm portion and an outer arm portion and each being arranged to pivotally attach, at what constitutes its inner end, to a support at one of opposite sides of a vehicle chassis to position said arms in a transversely spaced substantially parallel relation, said outer portions of said arms each being rigidly connected to form an extension of and depend from the outermost end of the inner arm portion of that arm of which it forms a part, said outer end portions of said arms each mounting a slidably related arm extension which is displaced outwardly from the outer end portion of the inner arm portion, said arm extensions forming part of a material handling assembly including a material handling device mounting in a pivotally related bridging relation to outer end portions of said arm extensions to render it tiltable to various attitudes of use, further means in connection with said arm extensions forming a self contained part of said material handling assembly, said further means being located at a point immediately to the rear of said material handling device and operable to effect tilting movements of said material handling device and to hold said device in a selected tilted position, means mounting adjacent to the outer end portion of the inner end portion of each said arm and extending along the outer dependent end portion thereof operable independently of the operation of said further means to effect essentially straight line inward and outward and reciprocating movements of said assembly on and with respect to said outer end portions of said arms and selectively with said material handling device held in any selected tilted position in which it may have been set for a spreading and levelling operation.

* * * * *

UNITED STATES PATENT AND TRADEMARK OFFICE

CERTIFICATE OF CORRECTION

PATENT NO. : 4,741,662

DATED : May 3, 1988

INVENTOR(S) : Gregory Schmiesing

It is certified that error appears in the above–identified patent and that said Letters Patent are hereby corrected as shown below:

Col. 3, line 54, "comprises" is corrected to read -- comprised --.

Col. 7, line 42, "amrs" is corrected to read -- arms --.

Col. 8, line 12, "chassic" is corrected to read -- chassis --.

Col. 12, line 63 (Claim 6, line 1) "30" is corrected to read -- 5 --.

Signed and Sealed this

Eleventh Day of October, 1988

*Attest:*

*Attesting Officer*

DONALD J. QUIGG

*Commissioner of Patents and Trademarks*